United States Patent [19]

Itoh et al.

[11] Patent Number: 4,469,168

[45] Date of Patent: Sep. 4, 1984

[54] FIN ASSEMBLY FOR HEAT EXCHANGERS

[75] Inventors: Masaaki Itoh, Tsuchiura; Mituo Kodoh, Shimizu; Akira Tomita, Mito; Masakatsu Hayashi; Takeo Tanaka, both of Ibaraki, all of Japan

[73] Assignee: Hitachi, Ltd., Tokyo, Japan

[21] Appl. No.: 238,040

[22] Filed: Feb. 25, 1981

[30] Foreign Application Priority Data

Feb. 27, 1980 [JP] Japan ..... 55-22746

[51] Int. Cl.[3] ..... F28D 1/02

[52] U.S. Cl. ..... 165/152; 165/153

[58] Field of Search ..... 165/152, 153, 151

[56] References Cited

U.S. PATENT DOCUMENTS

| | | | |
|---|---|---|---|
| 3,003,749 | 10/1961 | Morse | 165/152 |
| 3,250,325 | 5/1966 | Rhodes | 165/153 |
| 3,265,127 | 8/1966 | Nickol | 165/152 |
| 3,724,538 | 4/1973 | Yamaguchi | 165/152 |
| 3,810,509 | 5/1974 | Kun | 165/153 |
| 3,845,814 | 11/1974 | Kun | 165/148 |

FOREIGN PATENT DOCUMENTS

| | | | |
|---|---|---|---|
| 123954 | 4/1947 | Australia | 165/152 |
| 2380400 | 6/1962 | Fed. Rep. of Germany . | |
| 48-27263 | 8/1973 | Japan . | |
| 254 | 1/1979 | Japan | 165/152 |
| 54-61351 | 5/1979 | Japan . | |
| 2027533 | 2/1980 | United Kingdom | 165/153 |

*Primary Examiner*—William R. Cline

*Attorney, Agent, or Firm*—Antonelli, Terry & Wands

[57] ABSTRACT

A fin assembly for heat exchangers used in air conditioners or the like. The fin assembly is formed from a thin plate material which is bent and wound to have a plurality of alternating turns each of which constitutes a fin. The fin is provided with a multiplicity of louvers cut-out and raised from the major plane thereof. The fins are inclined at an angle $\theta$ which is 30° or smaller to the direction of flow of the gas entering the fin assembly, while the louvers are inclined at an angle $\gamma$ which is 20° or smaller to the direction of flow of the gas entering the fin assembly in the direction opposite to the direction of inclination of the fin plates.

5 Claims, 9 Drawing Figures

FIN ASSEMBLY FOR HEAT EXCHANGERS

BACKGROUND OF THE INVENTION

The present invention relates broadly to a heat exchanger of the type having a tube provided with a passage or passages through which a heat-exchange medium is circulated and a multiplicity of fin assemblies each having a large number of fins and attached to the tube so that a heat exchange is performed between the heat-exchange medium flowing in the tube and a gas flowing through the space between adjacent fins of each fin assembly. More particularly, the present invention is concerned with an improvement in the fin assembly for use in the heat exchanger of the type described.

Japanese Patent Publication No. 27263/1973 discloses a heat exchanger of the kind mentioned above, in which the fins of the fin assembly are inclined with respect to the direction of flow of the gas, and each fin has a plurality of louvers cut out and protruded from the major plane of the fin. These louvers are arranged in parallel with the direction of flow of the gas. In this known heat exchanger, it is intended, by inclining the fins, for the gas to be positively introduced and to flow through the gap between adjacent louvers, when the gas flows through the space between the fins, thereby increasing the heat transfer coefficient. However, since the louvers are arranged in parallel with the direction of flow of the gas, the gas does not flow through the gap between louvers in such a manner as to increase the heat transfer coefficient to a satisfactorily high level when the inclination of fins is small.

SUMMARY OF THE INVENTION

Accordingly, an object of the invention is to provide a fin assembly for heat exchangers having a high heat transfer coefficient.

Another object is to provide a fin assembly which is designed and constructed so as not to impose a large resistance on the gas flowing through the space between the fins.

Still another object is to provide a fin assembly for heat exchangers having a high heat transfer coefficient and reduced flow resistance against the gas flowing therethrough.

A further object of the invention is to provide a fin assembly for heat exchangers, in which the effect of louvers is most enhanced when the inclination angle of the fin to the direction of flow of gas is small.

To this end, according to the invention, there is provided a fin assembly having a multiplicity of fins each having a plurality of louvers cut-out and raised from the major plane thereof, wherein the fins are inclined at a predetermined angle $\theta$ to the direction of flow of gas flowing into the fin assembly and the louvers are inclined at a predetermined angle $\gamma$ to the direction of flow of the gas flowing into the fin assembly, in the opposite direction to the direction of inclination of the fins.

The gas flows into the fin assembly substantially perpendicularly to the line connecting the gas inlet side ends of the fins. Therefore, the fins are inclined at an angle $90°+\theta$ to the line connecting the gas-inlet side ends of the fins, whereas the louvers are inclined at an angle $90°-\gamma$ to the same line.

The angles $\theta$ and $\gamma$ can be selected as desired. However, when the fin assembly of the invention is used in the heat exchanger of an air conditioner, it is preferred that the inclination angles $\theta$ and $\gamma$ are selected to be smaller than 30° and 20°, respectively. In this state, the sizes of every part of the fin should be selected to meet the following conditions;

| | |
|---|---|
| pitch of the fins (distance between adjacent fins as viewed on the line connecting the gas-inlet ends of the fins, i.e. on the line perpendicular to the direction of entering flow of gas): | $l$ = 1.0 to 2.5 mm; |
| length of louvers: | $b$ = 1.0 to 2.5 mm; |
| wall thickness of fin: | $t$ = 0.10 to 0.20 mm; |
| mean flow velocity of gas: | $u$ = 0.8 to 5.0 m/sec; |
| coefficient of kinematic viscosity: | $\nu = 0.15 \times 10^{-4}$ m²/sec; (20° C. air) |
| Reynolds number of louver: | $Reb = \frac{u \cdot b}{\nu}$ 50 to 800; |

The above mentioned sizes and conditions are shown solely by way of example, because they are most popularly adopted in air conditioners. Thus, these sizes and conditions are not exclusive and the fin assembly of the invention can have any other sizes and conditions than those mentioned above.

The object of the invention is perfectly achieved when various parts of the fin assembly are sized to meet the following condition.

$$\sin 2\gamma = 2(t + \delta^*) \cdot \left(\frac{1}{b} - \frac{2 \sin\theta}{l}\right),$$

where $\delta^*$ represents the displacement thickness (m) of the rear end of the louver, which is expressed as follows;

$$\delta^* = 1.72 \frac{b}{\sqrt{Reb}};$$

The dimension of the angles $\gamma$ and $\theta$ is degrees, whereas the thickness and the length t, b, are expressed in terms of meters.

DESCRIPTION OF THE PREFERRED EMBODIMENTS

Figure 1:
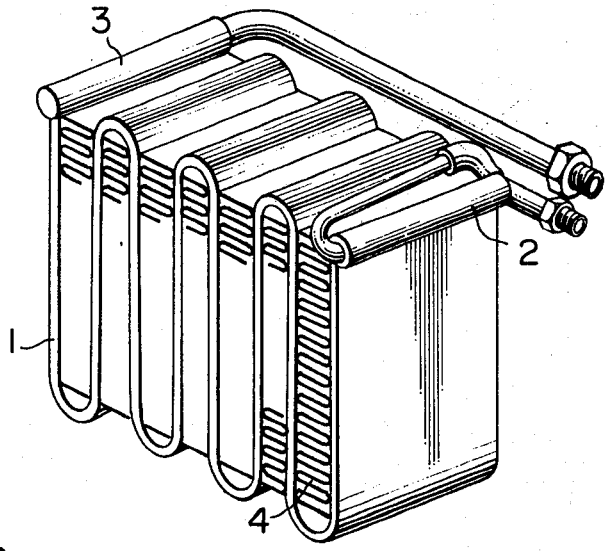
FIG. 1 is a perspective view of an example of a heat exchanger in which the fin assembly of the invention is incorporated.

Referring now to the drawings wherein like reference numerals are used in both views to designate like parts and, more particularly, to FIG. 1, according to this figure, a typical heat exchanger includes a tube 1, headers 2, 3 connected to both ends of the tube 1 and fin assemblies generally designated by the reference numeral 4 interposed between adjacent walls of the tube 1. A blower (not shown) generates a gas (air) flow around the tube 1.

The tube 1 has an elongated circular cross-section or a flattened rectangular cross-section, and is provided with longitudinal passages for heat-exchange medium. These passages are communicated at respective ends with the headers 2 and 3. The outer side of the tube 1 is provided at least with a flattened portion to which the fin assembly 4 is fixed by a known measure such as brazing.

The heat-exchange medium, in a gaseous state, flows into the first header 2 and then comes into the passages to flow through the latter, so that the gaseous heat-exchange medium is cooled and liquefied through a heat-exchange with the air flowing outside the tube 1 and the spaces in the fin assembly 4. The liquefied medium then flows out of the heat exchanger through the second header 3. In this state, the heat exchanger operates as a condenser or an air heater.

Alternatively, when the heat-exchange medium, in the liquid state, comes into the heat exchanger through the second header 3 and flows out of the heat exchanger through the first header 2 after heating and evaporation while it flows through the passages in the tube 1, the heat exchanger functions as an evaporator or an air cooler.

It is not essential that the medium makes a phase change while it flows through the tube 1. Namely, the fin assembly of the invention can be applied to such a heat exchanger that the medium flowing therethrough does not make a change of phase.

Figure 2:
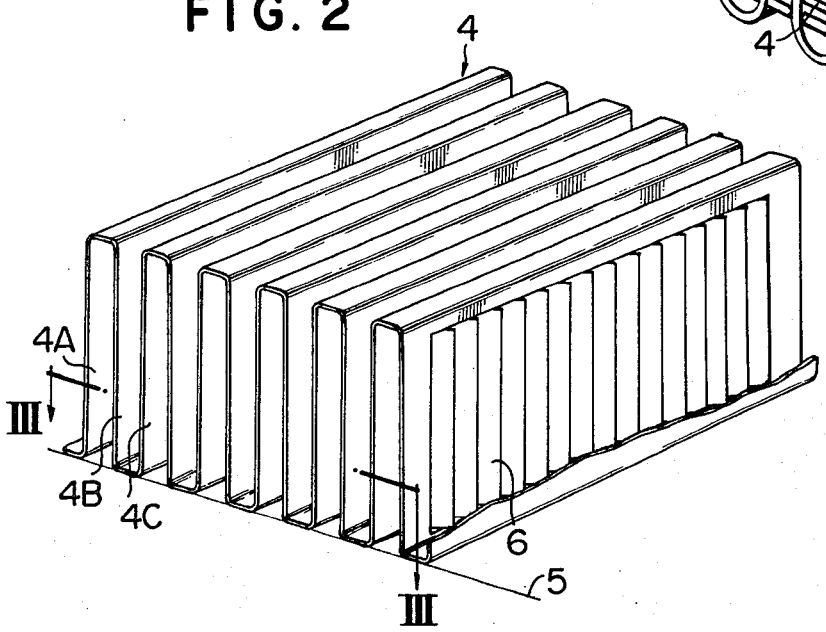
FIG. 2 is a perspective view of a fin assembly constructed in accordance with an embodiment of the invention.
Figure 3:
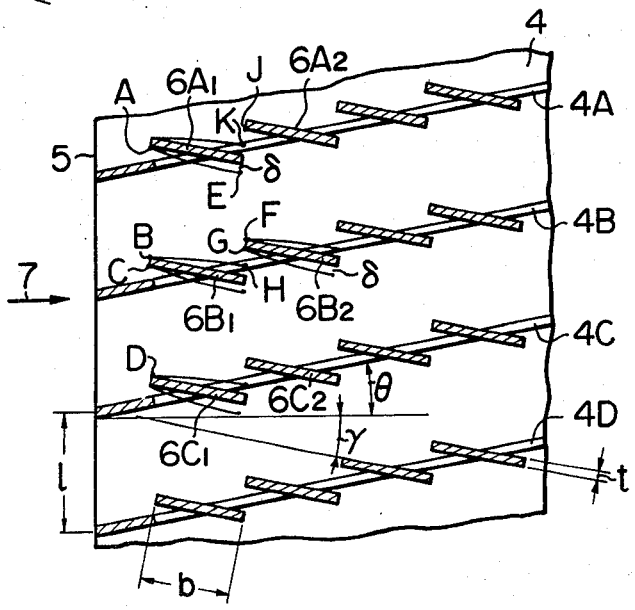
FIG. 3 is an enlarged sectional view taken along the line III—III in FIG. 2 in a larger scale at magnification 10.

As shown in FIGS. 2 and 3, the fin assemblies 4 are formed from a thin plate material bent and wound to have a plurality of alternating turns which constitute fins 4A, 4B, 4C. These fins are inclined at an angle of $90°+\theta$ to the line 5 interconnecting the ends of the fins. Each of the fins 4A, 4B, 4C is provided with a plurality of louvers 6 cut-out and raised from the major surface thereof. These louvers 6 are inclined at an angle of $90°-\gamma$ to the line 5.

The direction 7 of flow of the gas (air), flowing into the fin assembly 4, is perpendicular to the line 5. Therefore, the fins 4A, 4B, 4C are inclined at the angle $\theta$ to the direction 7 of the flow of gas, whereas the louvers 6 are inclined to the same at the angle $-\gamma$.

In the illustrated embodiment, the sizes of every part of the fin assembly 4 and various operating conditions are selected as shown in Table 1 below.

TABLE 1

| | |
|---|---|
| inclination angle of fin | $\theta$: 10° |
| inclination angle of louver | $\gamma$: about 10° |
| length of louver | b: 1.6 mm |
| pitch of fin | l: 2.0 mm |
| thickness of fin assembly | t: 0.16 mm |
| flowing velocity of air | 2.1 m/sec |
| coefficient of kinematic viscosity | $\upsilon$: $0.156 \times 10^{-4}$ m²/sec (at 20° C.) |
| Reynolds number of louver | Reb: 215 |
| displacement thickness at rear end of louver | $\delta^*$: 0.19 mm |

When the fin assembly 4 is placed in the flow of air, the air flowing into the gap between the adjacent first louvers of first row $6A_1$, $6B_1$ is, as shown most clearly in FIG. 3, divided into two parts one of which flows between a lower edge E of the louver $6A_1$ and the upper edge F of the lower louver $6B_2$ while the other flows between lower edge G of inlet side of the louver $6B_2$ and upper edge H of outlet side of the louver $6B_1$, thus entering the second row of louvers. Air components coming through the gaps JK, GH are introduced into the gap EF between the louvers $6A_2$, $6B_2$. The air quantity coming through the gap JK is able to be controlled by controlling the inclination of fins $\theta$ and the inclination of louvers $\gamma$ adequately. Thus, the direction of flow of air in the fin assembly 4 as a whole substantially coincides with the flowing direction 7 entering the fin assembly 4.

Namely, in the fin assembly 4, there are two parts of flow of air, one being the major flow moving in the space between adjacent fins 4A, 4B, 4C, and shunting part which moves from the space between the fins 4A and 4B into the space between the fins 4B and 4C, through adjacent louvers 6. These parts are joined to each other to form a general flow of air the direction of which substantially coincides with the direction 7 of air entering the fin assembly 4.

In the fin assembly of the invention in which the general flow of air in the fin assembly 4 substantially coincides with the flowing direction 7 of air entering the fin assembly 4, while the fins are inclined to the direction of 7 of air entering the fin assembly 4, the air is positively guided to flow through the gap between adjacent louvers 6 to remarkably promote the heat transfer coefficient between the fin assembly and air. This arrangement also permits a reduction of flow resistance against the air flowing through the fin assembly 4.

Although the above-mentioned sizes and conditions can be adopted suitably, these sizes and conditions are not exclusive but can be varied as desired within the range as specified in the preamble portion of the specification.

It is to be noted also that the objects of the invention are perfectly achieved when the condition expressed by the following equation (1) is satisfied:

$$\text{Sin } 2\gamma = 2(t + \delta^*) \cdot \left( \frac{1}{b} - \frac{2 \text{ Sin}\theta}{l} \right), \quad (1)$$

where, $\gamma$: inclination angle of louver 6 to the direction of flow of gas (degree);

$\theta$: inclination of fins of fin assembly 4 to the direction of flow of gas (degree);

t: plate thickness of louver 6 (meter);

b: length of louver (meter);

l: pitch of the fin as measured on the line 5 interconnecting the ends of the fins of the fin assembly (meter);

Reb: Reynolds number of louver $(u \cdot b)/\nu$;

u: flow velocity of gas (meter/sec);

$\nu$: kinetic viscosity of gas (square meter/sec); and $\delta^*$: displacement thickness at rear end of louver $$\zeta^* = 1.72 \frac{b}{\sqrt{Reb}}.$$

Figure 4:
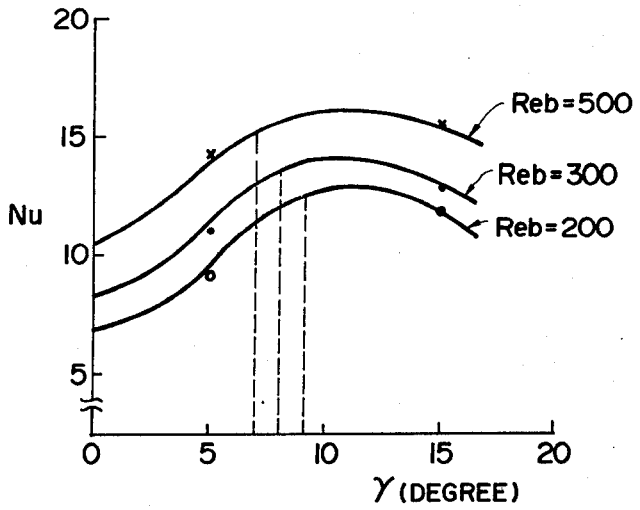
FIGS. 4, 5 and 6 show characteristic curves showing the relationship between Nusselt's number and inclination angle $\gamma$ obtained through experiments.
Figure 5:
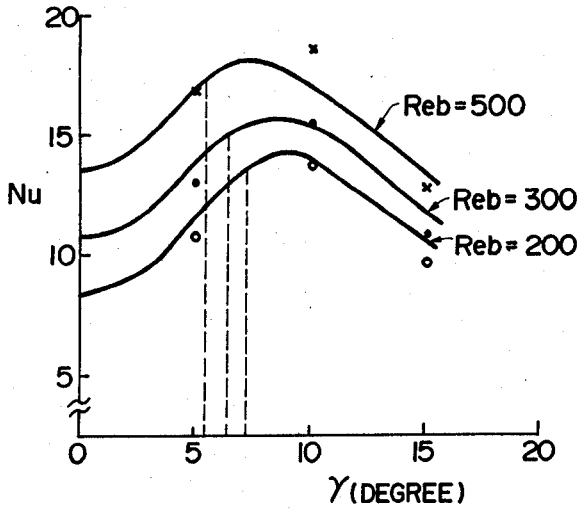
Figure 6:
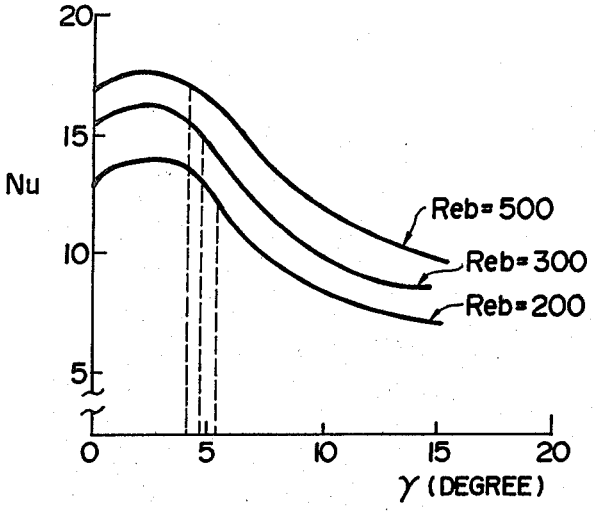

An experiment was conducted to investigate how the Nusselt's number Nu is changed by a change of the inclination angle $\gamma$ of the louver 6 to the direction 7 of flow of gas, the result of which is shown in FIGS. 4, 5 and 6.

More specifically, the characteristic shown in FIG. 4 was obtained under the condition of $\theta=5°$, b=1.6 mm, l=2.0 mm and t=0.16 mm, with the use of air as the gas. The characteristic shown in FIG. 5 was observed when the conditions are $\theta=10°$, b=1.6 mm, l=2.0 mm and t=0.16 mm, using air as the gas. Similarly, the characteristic shown in FIG. 6 was observed under the conditions of $\theta=15°$, b=1.6 mm, l=2.0 mm and t=0.16 mm, using air as the gas. The Reynolds numbers Reb were 200, 300 and 500, respectively. The Nusselt's number is, as is known to those skilled in the art, a number expressing the heat transfer in a dimensionless coefficient.

In FIGS. 4–6, the condition $\gamma=0$ corresponds to the fin assembly of the prior art mentioned in the description of the prior art in this specification.

From FIGS. 4–6, it will be seen that a substantial improvement of the performance is achieved as compared with the prior art fin assembly having inclination angle $\gamma$ of zero, when the angle $\gamma$ falls within the range shown in Table 2 below.

TABLE 2

| $\theta$ | inclination angle $\gamma$ of louver |
|---|---|
| 5° | $0° < \gamma \leqq 20°$ |
| 10° | $0° < \gamma \leqq 17°$ |
| 15° | $0° < \gamma \leqq 7°$ |

Preferably, the inclination angle $\gamma$ falls within the range shown in Table 3 below, because these ranges ensures 20% or higher improvement as compared with the prior art fin assembly in which the inclination angle $\gamma$ is zero.

TABLE 3

| $\theta$ | inclination angle $\gamma$ of louver |
|---|---|
| 5° | $5° \leqq \gamma \leqq 15°$ |
| 10° | $4° \leqq \gamma \leqq 12°$ |
| 15° | $2° \leqq \gamma \leqq 6°$ |

The highest performance is obtained when the inclination angle $\gamma$ ranges between a value 10% higher than that derived from equation (1) and a value 10% lower than the same, irrespective of the value of the angle $\theta$. The adequacy of the equation (1) is proved by the fact that the peak values obtained through experiments well conform with those calculated from the equation (1).

In FIGS. 4 to 6, the broken lines show the inclination angle $\gamma$ calculated from the equation (1) for each Reynolds number.

In the heat exchangers, the reduction of flow resistance against the gas also is an essential requisite. The fin assembly which imposes a high resistance to flow of gas flowing therethrough is useless, however the heat transfer coefficient may be increased. Therefore, according to the invention, the performance of the fin assembly 4 is evaluated using a non-dimensional number ($j_h/C_f$) obtained through division of the heat transfer performance by the flow resistance of gas, as the evaluation factor. The results of the evaluation are shown in FIGS. 7, 8 and 9.

Both of the heat transfer performance and the flow resistance are increased as the Reynolds number Reb is increased, although the rate of increase are not always equal, so that no substantial change of the value $j_h/C_f$ was caused by the change of the Reynolds number, when the latter falls within the order of $10^2$ to $10^3$.

Figure 7:
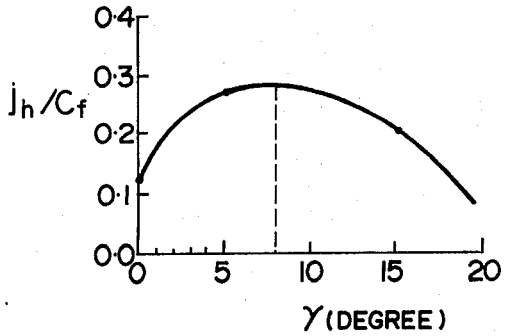
FIGS. 7, 8 and 9 are characteristic curves showing the relationship between a non-dimensional number $j_h/c_f$ and the inclination angle $\gamma$.
Figure 8:
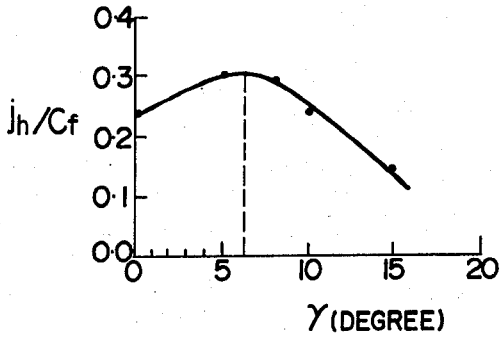
Figure 9:
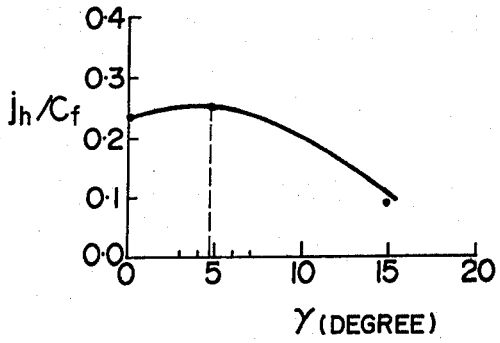

From FIGS. 7–9, it will be seen that 20% or higher improvement is achieved over the prior art fin assembly, when the inclination angle $\gamma$ ranges between 3° and 13°, between 3° and 10° and between 2° and 6°, respectively, in the cases where the inclination angle $\theta$ is 5° (FIG. 7), 10° (FIG. 8) and 15° (FIG. 9).

In FIGS. 7 to 9, the broken lines show the values of inclination angle $\gamma$ calculated from the equation (1) for each Reynolds number. Symbols $j_h$ and $c_f$ represent j factor and friction coefficient, respectively.

According to the evaluation taking into account the flow resistance, the range of the preferred inclination angle $\gamma$ of louver for obtaining the favorable result is shifted to the lower side. It is also to be noted that the peak value of $j_h/c_f$ well conforms with the value calculated from the equation (1).

What is claimed is:

1. A fin assembly arranged in a region between end portions of an inlet side and an outlet side of a gas flow in heat exchanger tubes, the fin assembly having a plurality of fins, each fin having a plurality of louvers cut-out and raised from a major planar surface thereof and into which assembly the gas flows in a direction substantially perpendicular to a plane connecting inlet side ends of the fins, said louvers including longitudinally extending edges directed toward the gas flow substantially at right angles to the direction of the gas flow, said fins are inclined at an angle $\theta$ in one direction to the direction of the gas flow into said fin assembly, and said louvers are inclined at an angle $\gamma$ to the direction of the gas flow into the fin assembly, in the opposite direction to the direction of inclination of the fins, said angles $\theta$ and $\gamma$ are respectively between 90° and 0° and are selected to meet the following conditions:

$$\sin 2\gamma = 2(t + \delta^*) \cdot \left(\frac{1}{b} - \frac{2 \sin\theta}{l}\right)$$

where, t: wall thickness of fins (m);

b: length of louver (m);

l: pitch of fins as measured on a line substantially perpendicular to the direction of the entering flow of gas connecting the ends of the fins (m);

$\theta$: inclination angle of fin to the direction of entering flow of gas (degree);

$\gamma$: inclination angle of louver to the direction of entering flow of gas (degree);

$\delta^*$: displacement thickness at rear end of louver $$= 1.72 \frac{b}{\sqrt{Reb}};$$

Reb: Reynolds number of louver $(u \cdot b)/\nu$;

u: flowing velocity of gas (m/sec); and $\nu$: kinetic viscosity of gas ($m^2$/sec).

2. A fin assembly as claimed in claim 1, wherein said angle $\theta$ and said angle $\gamma$ are selected to be 30° or smaller and 20° or smaller, respectively.

3. A fin assembly as claimed in claim 1, wherein said angle $\theta$ and said angle $\gamma$ are selected to be 15° or smaller and 20° or smaller, respectively.

4. A fin assembly as claimed in claim 1, wherein said angle $\theta$ is selected to be 15° or smaller, while said angle $\gamma$ is selected to range between 15° and 2°.

5. A fin assembly as claimed in any one of the claims 1, 2, 3, or 4, wherein values of t, b, l of the fin assembly and conditions of the gas Reb and u are selected to range as follows:

t=0.10 to 0.20 mm, b=1.0 to 2.5 mm, l=1.0 to 2.5 mm, Reb=50 to 800, u=0.7 to 5.0 m/sec.

* * * * *